US009472893B1

(12) United States Patent
Motohashi et al.

(10) Patent No.: US 9,472,893 B1
(45) Date of Patent: Oct. 18, 2016

(54) CONNECTOR

(71) Applicant: YAZAKI CORPORATION, Tokyo (JP)

(72) Inventors: Yuuichirou Motohashi, Shizuoka (JP); Takaaki Miyajima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/062,518

(22) Filed: Mar. 7, 2016

(30) Foreign Application Priority Data

Mar. 31, 2015 (JP) ..... 2015-072761

(51) Int. Cl.
*H01R 13/533* (2006.01)
*H01R 13/512* (2006.01)
*H01R 13/6581* (2011.01)

(52) U.S. Cl.
CPC ..... *H01R 13/533* (2013.01); *H01R 13/512* (2013.01); *H01R 13/6581* (2013.01)

(58) Field of Classification Search
CPC ..... H01R 13/533; H01R 13/6315; H01R 13/631; H01R 33/9753
USPC ..... 439/382, 247, 248
See application file for complete search history.

(56) References Cited

U.S. PATENT DOCUMENTS 5,306,169 A * 4/1994 Fukushima ..... H01R 12/712 439/248
6,939,154 B2 * 9/2005 Horikoshi ..... G11B 33/08 439/247
7,892,001 B2 * 2/2011 Hanyu ..... H01R 23/68 439/247
8,585,421 B2 * 11/2013 Yamaguchi ..... H01R 13/05 439/248
9,343,825 B2 * 5/2016 Kashiwada ..... H01R 4/38
2001/0019912 A1 * 9/2001 Kain ..... H01R 12/724 439/247
2004/0166744 A1 8/2004 Inaba et al.
2014/0051286 A1 * 2/2014 Itsuki ..... H01R 13/533 439/587
2014/0120763 A1 * 5/2014 Itsuki ..... H01R 13/5825 439/382
2015/0288083 A1 * 10/2015 Kashiwada ..... H01R 4/38 439/247
2016/0164233 A1 * 6/2016 Zhu ..... H01R 24/542 439/248

FOREIGN PATENT DOCUMENTS

JP 2004-253163 A 9/2004
JP 2013-232371 A 11/2013

* cited by examiner

*Primary Examiner* — Gary Paumen
(74) *Attorney, Agent, or Firm* — Kenealy Vaidya LLP

(57) ABSTRACT

A connector including a housing which formed with a work opening in an outer surface on a side of an outer corner of the L-like bent shape of the housing, further includes a lid attached to the work opening, a fixed terminal configured to be inserted through the external-wire leading portion and accommodated in the housing, and a flexible conductor connecting the terminal to one end of the fixed terminal and including an external-force absorbing portion sagging between both ends of the flexible conductor. The other end of the fixed terminal is connected to a conductor of the external wire, and an intermediate portion of the fixed terminal is fixed to the housing and elongates along the axis of the external wire.

4 Claims, 7 Drawing Sheets

CONNECTOR

CROSS REFERENCE TO RELATED APPLICATIONS

This application is based on Japanese Patent Application (No. 2015-072761) filed on Mar. 31, 2015, the contents of which are incorporated herein by way of reference.

BACKGROUND

The present invention relates to a connector.

As a connector which is to be used in a vehicle or the like, a structure has been known in which a relay terminal is attached to an electric wire for supplying an electric current to a load, and the wire is connected through the relay terminal to a female terminal that is connected to a power supply. In this structure, the relay terminal is accommodated in a rear connector, the female terminal is accommodated in a front connector, and the front connector is assembled to a rear connector, thereby forming a connector (see Patent Literature 1).

When the front and rear connectors are assembled to each other in a state where a tolerance exists between the connectors, however, the position of the female terminal with respect to a mating terminal of the counter connector is shifted. Therefore, there arises a disadvantage that the female terminal fails to be in contact with the mating terminal. In a vehicle, vibrations during travelling are transmitted to the wire, and further transmitted to the female terminal through the relay terminal to vibrate the female terminal. The vibrations cause the female terminal and the mating terminal to wear, and cutting products formed in the wearing may metamorphose to cause the conductivity to be reduced.

Therefore, Patent Literature 2 discloses a connector in which a tolerance can be absorbed, and vibrations are not transmitted to a female terminal. As shown in FIG. 7, the connector 501 includes: plate-like terminals 505 respectively connected to terminals of electric wires 503; a rear connector 507 in which the plate-like terminals 505 are accommodated; and a front connector 511 in which box-shaped female terminals 509 that are assembled into the rear connector 507, and that are respectively connected to the plate-like terminals 505 are accommodated. The female terminals are to be connected to mating terminals which are on the side of an electric apparatus, respectively. The plate-like terminals 505 are connected to the female terminals 509 through connecting terminals 513 which are formed by soft members that can absorb positional displacements between the plate-like terminals 505 and the female terminals 509, and vibrations of the plate-like terminals 505, respectively.

A shield shell 515 is configured by an upper shell 517 and an under shell 519, and the shells are assembled by holding brackets 521. The front connector 511 is formed by a front housing body 523 (front housing) and a housing front 525. The housing front 525 has a lower front portion 527 and an upper front portion 529, and these members can be assembled to each other.

In the connector 501, the plate-like terminals 505 are connected to the female terminals 509 through the connecting terminals 513. Even when a tolerance exists between the rear connector 507 and the front connector 511, therefore, it is possible to absorb positional displacements corresponding to the tolerance and between the female terminals 509 and the plate-like terminals 505, and also to fix the female terminals 509 at predetermined positions of the front connector 511. Therefore, the female terminals 509 can be satisfactorily contacted with mating terminals.

In the case where the plate-like terminals 505 are vibrated by vibrations transmitted from the wires 503, the connecting terminals 513 which are formed by soft members absorb the vibrations, and hence the vibrations are not transmitted to the female terminals 509. Therefore, vibrations can be prevented from being transmitted between the female terminals 509 and mating terminals of a counter connector which is on the side of an electric apparatus, with the result that the female terminals 509 can be surely connected to the mating terminals.

[Patent Literature 1] JP-A-2004-253163

[Patent Literature 2] JP-A-2013-232371

SUMMARY

It is therefore to one advantageous aspect of the invention to provide a connector which can be easily assembled while improving the contact reliability.

According to one aspect of the invention, there is provided a connector comprising:

a terminal configured to be connected to a mating terminal;

a front holder accommodating the terminal therein;

a housing having an L-like bent shape, including a holder inserting portion into which the front holder is inserted in an alignable manner and an external-wire leading portion from which an external wire is led out, and formed with a work opening in an outer surface on a side of an outer corner of the L-like bent shape, wherein a center line of the holder inserting portion extends in a holder inserting direction in which the front holder is inserted into the holder inserting portion, a center line of the external-wire leading portion extends along an axis of the external wire, and the center line of the holder inserting portion intersects the center line of the external-wire leading portion to form the housing into the L-like bent shape;

a lid member attached to the work opening;

a fixed terminal configured to be inserted through the external-wire leading portion, and accommodated in the housing, wherein one end of the fixed terminal is connected to a conductor of the external wire, and an intermediate portion of the fixed terminal is fixed to the housing and elongates along the axis of the external wire;

a flexible conductor connecting the terminal to the other end of the fixed terminal, and including an external-force absorbing portion sagging between both ends of the flexible conductor.

The intermediate portion of the fixed terminal may be fastened and fixed to the housing by a bolt which is inserted through the work opening.

A portion of the fixed terminal to which the flexible conductor is connected may be bent and inclined toward the work opening.

A shield shell covering the housing and configured to be fixed to an electric apparatus may be fixed to the housing by a bolt.

DETAILED DESCRIPTION OF EXEMPLIFIED EMBODIMENT

Figure 1:
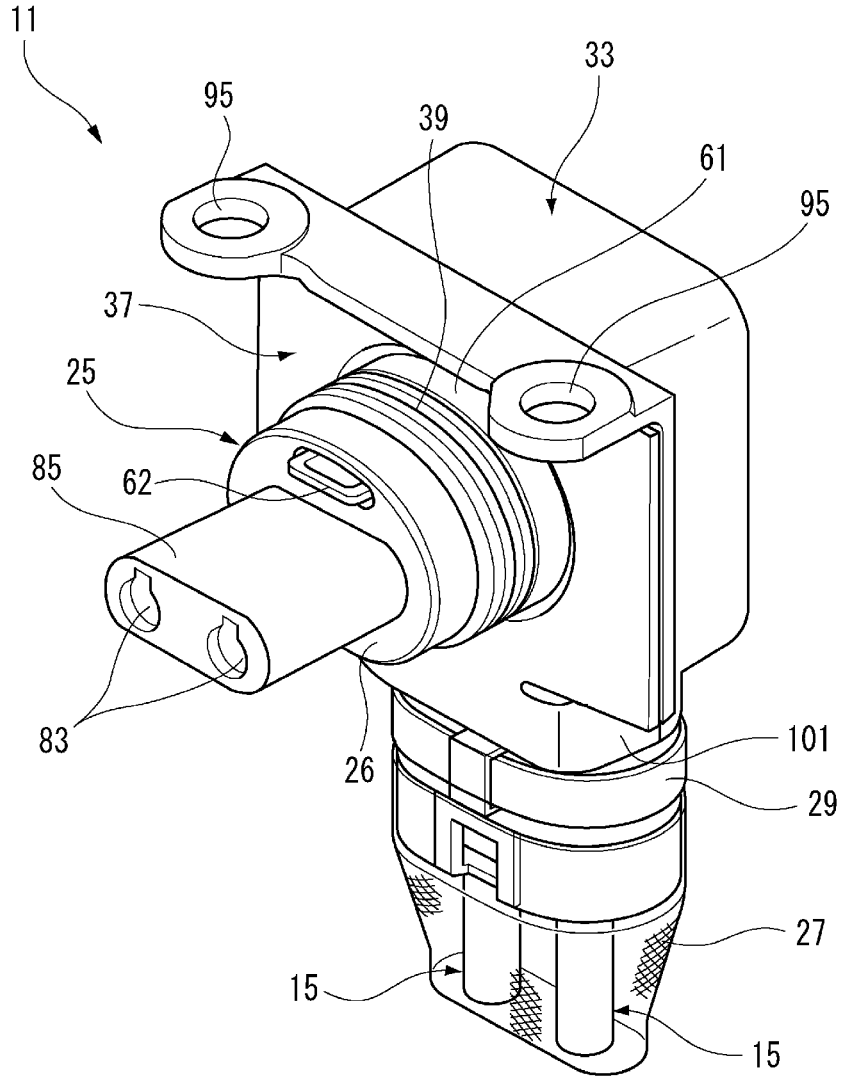
FIG. 1 is a perspective view of a connector of an embodiment of the invention.
Figure 2:
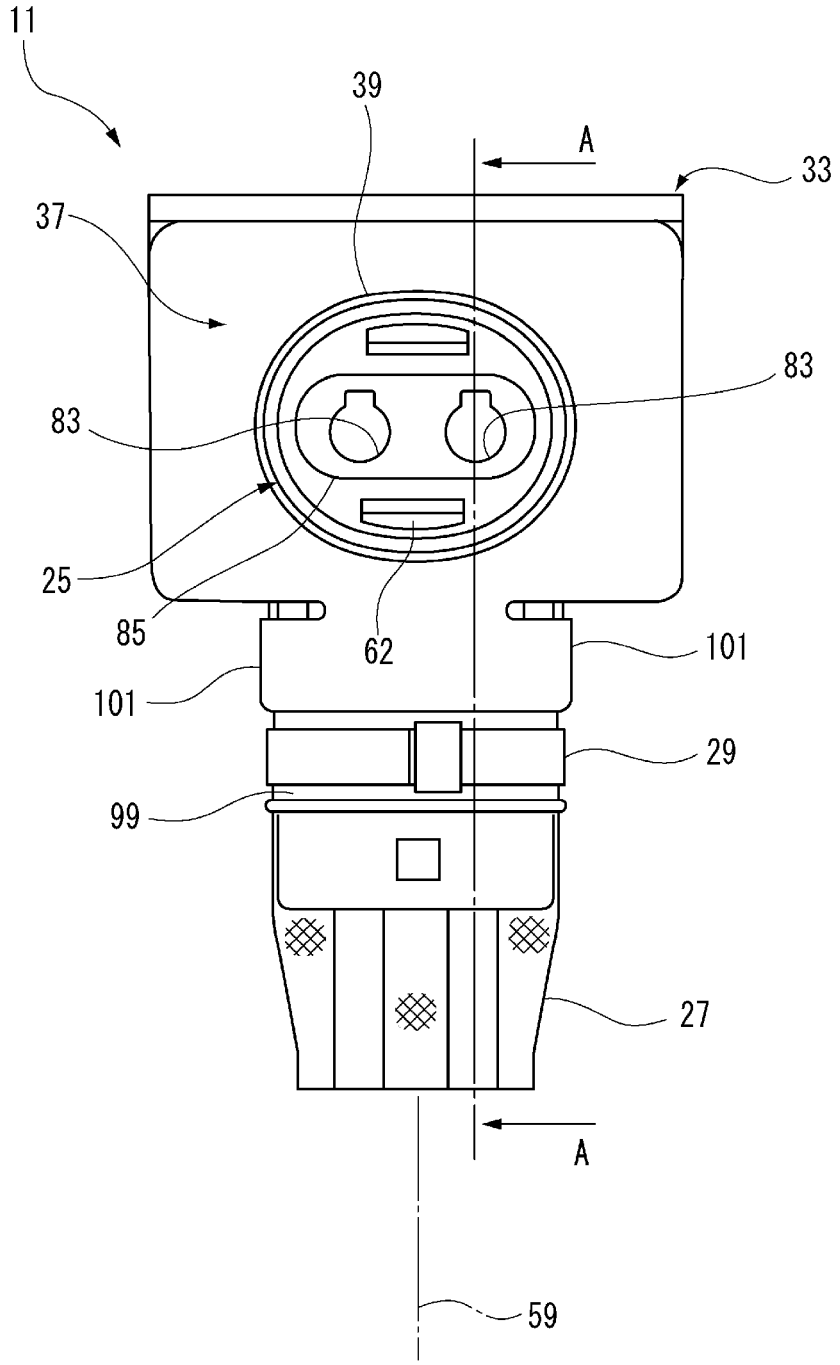
FIG. 2 is a front view of the connector shown in FIG. 1.

The above-described prior art connector 501 is produced by integral molding or by setting the plate-like terminals 505 into a molding die, injecting an insulating resin into the molding die, and hardening the resin into a state where a mold waterproof portion 531 and terminal portions of the wires 503 are embedded into a rear housing 533. The inclusion of such molding steps in the production process causes the assembly of the connector 501 to be cumbersome, and impedes the improvement of the productivity. Patent Literature 2 which discloses the connector 501 describes that the mold waterproof portion 531 and the rear housing 533 may not be integrally molded, but the rear connector 507 may be previously molded, and the wires 503 and the plate-like terminals 505 may be placed in an assembled state in the molded rear connector 507. In the case of L-shape terminals, when the terminals are once connected to the wires 503, however, it is usually difficult to insert the terminals into the housing. In such a case, for example, it may be contemplated that a work opening is formed in the housing. In the assembling work in this case, the wires are passed into the housing, and then once pulled out to the outside through the work opening. Thereafter, the L-shape terminals are connected to the wires, and then a work of again accommodating the wires together with the L-shape terminals in the housing is conducted. In the case of so-called thick wires which cannot be easily bent, however, a work of pulling out the wires which have been once passed through the interior of the housing, connecting terminals to the wires by means of crimping or the like, and thereafter again accommodating the wires into the housing is very cumbersome. Even in the case where a work opening is disposed as described above, L-shaped terminals are hardly inserted and extracted through a work opening together with thick wires.

The invention has been conducted in view of the above-discussed situations. It is an object of the invention to provide a connector which can be easily assembled while improving the contact reliability.

Hereinafter, an embodiment of the invention will be described with reference to the drawings.

For example, a connector 11 of the embodiment of the invention is to be attached to a shield case (metal case or the like) of a PC (Power Control unit), inverter, motor, or the like for a hybrid vehicle, an electric vehicle, or the like.

As shown in FIGS. 1 to 4, the connector 11 of the embodiment has terminals 13, a front holder 25, external wires 15, a housing 17, a lid member 19, conductor coupling fixed terminals 21 (fixed terminals), and flexible conductors 79 as main components.

The connector 11 further has a rear holder 23, an electromagnetic shielding braid 27, a metal band 29, a rubber plug 31, a shield shell 33, shell fixing bolts 35, a shell holder 37, a unit packing 39, and terminal fixing nuts 41.

Figure 3:
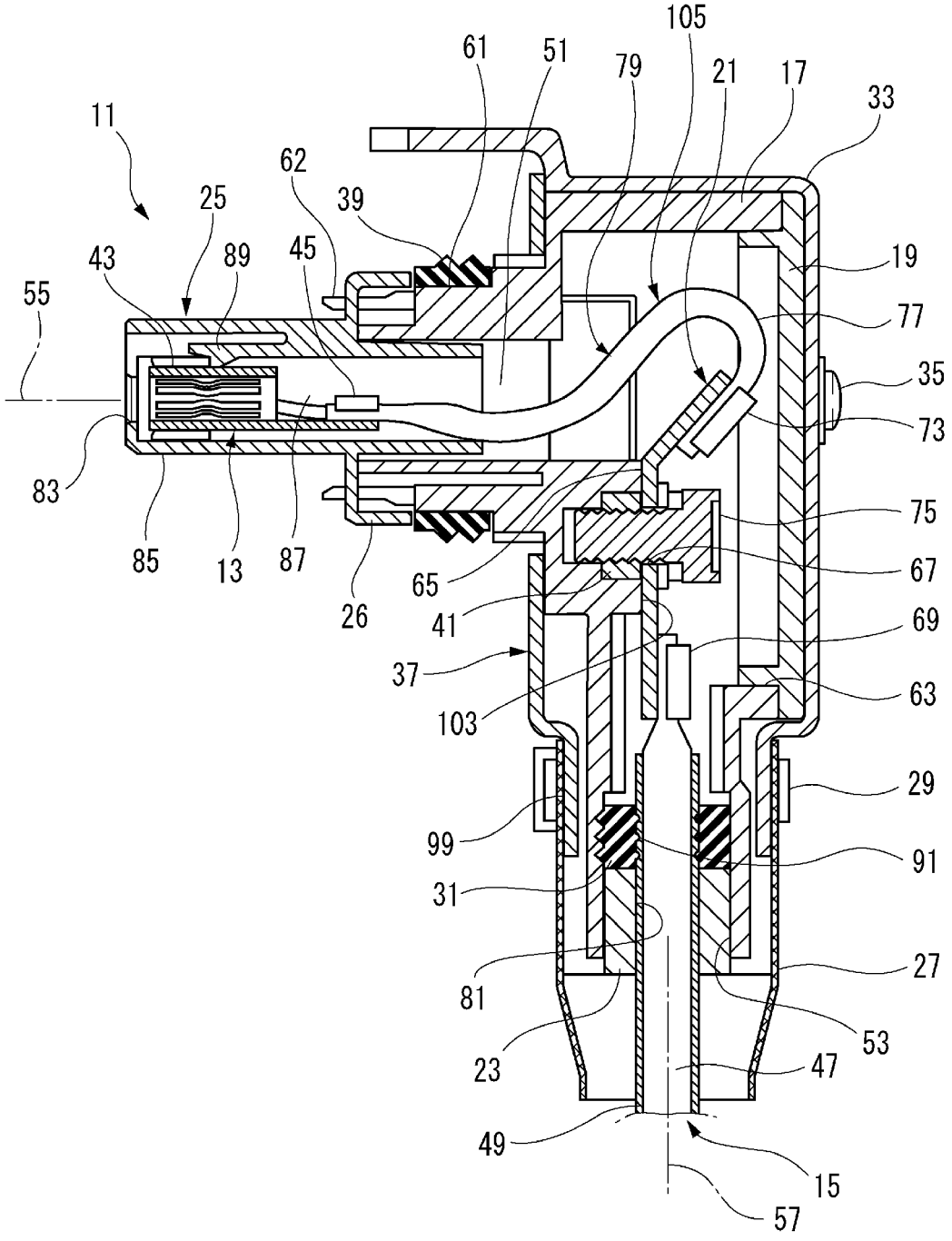
FIG. 3 is a sectional view looking in the direction of the arrows A-A in FIG. 2.
Figure 4:
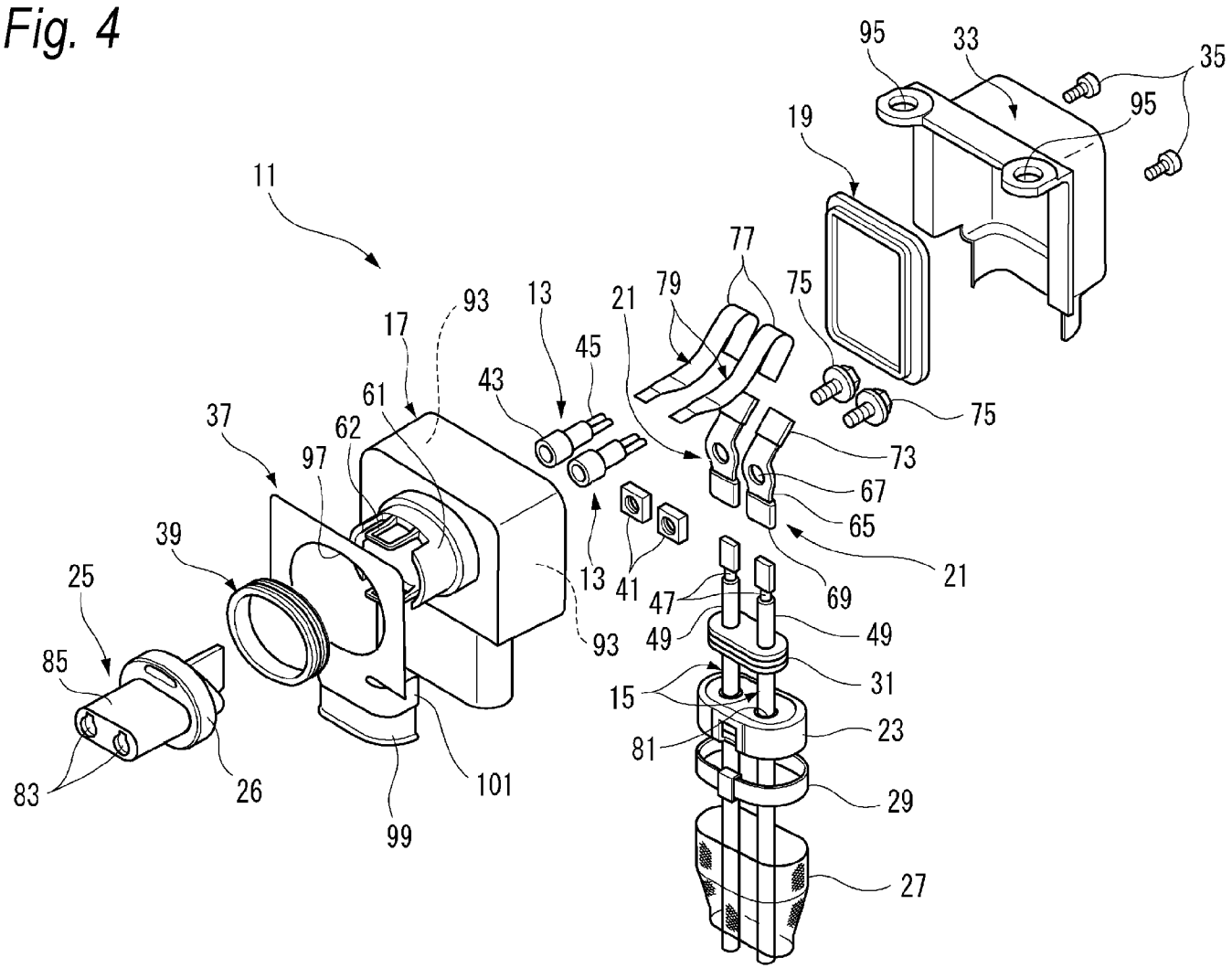
FIG. 4 is an exploded perspective view of the connector shown in FIG. 1.

As shown in FIG. 3, the terminals 13 which are accommodated in the front holder 25 are made of a conductive metal, and have cylindrical electric contacting portions 43 in the tip end side, respectively. The embodiment has two terminals 13. Rod-like electric contacting portions (not shown) of mating terminals enter the electric contacting portions 43, respectively. When the rod-like electric contacting portions enter the interiors of the electric contacting portions 43, the electric contacting portions are electrically connected to the rod-like electric contacting portions, respectively. Each of the terminals 13 has an electric connecting portion 45 which is continuous to the corresponding electric contacting portion 43, in the rear end side. The electric connecting portion 45 is connected to one end portion of the corresponding flexible conductor 79.

The external wires 15 have conductive core wires 47 (conductors), and insulative covering portions 49 which cover the core wires 47, respectively, and are covered by the electromagnetic shielding braid 27 which is electrically conductive. In each of the external wires 15, the core wire 47 is electrically connected to one end side of the conductor coupling fixed terminal 21. The electromagnetic shielding braid 27 is electrically connected to the shield shell 33.

The housing 17 is formed into a substantially L-like shape by an insulative synthetic resin. In the housing 17, a holder inserting portion 51 is formed to which the front holder 2 accommodating the terminals 13 is attached. In the L-like housing 17, an external-wire leading portion 53 is formed in the end opposite to the holder inserting portion 51. The external-wire leading portion 53 leads the external wires 15 which are connected to the conductor coupling fixed terminals 21 inside the housing 17, to the outside.

The housing 17 is formed into a shape in which a holder inserting portion center line 55 (see FIG. 3) that extends in a terminal inserting direction of the holder inserting portion 51 intersects with an external-wire leading portion center line 59 (see FIG. 2) that extends along a wire axis 57 (see FIG. 3) of the external-wire leading portion 53, and which is bent into a substantially L-like shape. In the embodiment, the holder inserting portion center line 55 and the external-wire leading portion center line 59 perpendicularly intersect with each other. As shown in FIG. 3, that is, the housing 17 is formed into an L-like shape which is bent by 90°. In the housing 17, an outer circumferential portion of the holder inserting portion 51 is formed as a tubular hood portion 61. The shell holder 37, the unit packing 39, and a lock portion 26 of the front holder 25 are attached to the hood portion 61.

The lid member 19 is detachably attached to the housing 17. In the housing 17, a work opening 63 is formed in the outer surface which extends along the wire axis 57 on the side of the L-shape outer corner. The interior of the housing 17 is exposed to the outside through the work opening 63. In the embodiment, the work opening 63 is formed into a rectangular shape which elongates in the direction of the wire axis 57. The work opening 63 has an opening area which allows the conductor coupling fixed terminals 21, the terminals 12 connected to the flexible conductors 79, or the conductor coupling fixed terminals 21 in a state where they are connected to the external wires 15 and the flexible conductors 79, to be inserted into and extracted from the housing 17.

The conductor coupling fixed terminals 21 are made of a conductive metal. Each of the conductor coupling fixed terminals 21 extends in the direction of the wire axis 57, and is formed into a strip-like shape, thereby being formed to be passable through the external-wire leading portion 53. A bolt passing hole 57 is opened in an intermediate portion 65 of the conductor coupling fixed terminal 21. A wire conductor-side connecting portion 69 is formed in one end side of the conductor coupling fixed terminal 21, and connected to the core wire 47 of the corresponding external wire 15. A flexible conductor-side connecting portion 73 is formed in another end side of the conductor coupling fixed terminal 21, and connected to the other end portion of the corresponding flexible conductor 79. The wire conductor-side connecting portion 69 and the external wire 15, and the flexible conductor-side connecting portion 73 and the flexible conductor 79 are connected to each other by means of, for example, crimping. Alternatively, the connection may be performed by brazing, ultrasonic bonding, resistance welding, laser welding, or the like.

The conductor coupling fixed terminals 21 are accommodated inside the housing 17 while their intermediate portions 65 are fixed to the housing 17. The intermediate portions 65 of the conductor coupling fixed terminals 21 are fastened and fixed to the housing 17 by bolts 75 which are inserted in bolt passing holes 67 through the work opening 63. The intermediate portions 65 elongates along the wire axis 57.

In the embodiment, in each of the conductor coupling fixed terminals 21, the flexible conductor-side connecting portion 73 which is the other end side is bent and inclined toward the work opening 63 as shown in FIG. 3. Alternatively, the conductor coupling fixed terminals 21 may be formed into a strip-like shape of a level surface, or without being bent. In each of the conductor coupling fixed terminals 21, the flexible conductor-side connecting portion 73 is inclined, thereby enabling an external-force absorbing portion 77 of the corresponding flexible conductor 79 to be easily formed into a loop-like shape.

In each of the flexible conductors 79, the one end portion is connected to the corresponding terminal 13, and the other end portion is connected to the other end side (flexible conductor-side connecting portion 73) of the corresponding conductor coupling fixed terminal 21. In the flexible conductor 79, the external-force absorbing portion 77 due to sagging is disposed between the one end portion and the other end portion. An extra length is disposed in the flexible conductor 79, and therefore the external-force absorbing portion 77 is formed into a loop-like shape (arcuate shape) because of the sagging of the conductor. No tension is applied to the external-force absorbing portion 77. When vibrations or tension is applied from the outside to the portion, therefore, the portion is easily displaced, whereby the vibrations or the tension can be absorbed (attenuated).

In the embodiment, each of the flexible conductors 79 is configured by a braided wire. A braided wire can be formed as a member in which conductive metal strands are woven at a predetermined braiding angle into a tubular shape. When a braid which has been woven into a tubular shape is flatly collapsed, a strip-like braided wire can be formed. The degree of flexibility of a braided wire can be adjusted by selecting the strand diameter, the pitch, and the braiding angle. As the flexible conductors 79, alternatively, a stranded wire configured by annealed copper wires, a stacked member configured by conductive thin plates, or the like may be used.

The rear holder 23 is molded into a long columnar shape by using a synthetic resin. External-wire passing holes 81 through which the pair of external wires 15 are respectively passed are opened in the rear holder 23. In a state where the external wires 15 are passed through the rear holder 23, the rear holder is engagedly held by the external-wire leading portion 53 of the housing 17. The rear holder 23 holds the rubber plug 31 which is on the front side in the insertion direction of the external wire 15, and which is attached to the external wire 15, into the external-wire leading portion 53.

In the front holder 25, a pair of counter-terminal insertion ports 83 into which the mating terminals (not shown) are to be inserted are formed in a terminal engagement tubular portion 85. In the front holder 25, in a state where the lock portion 26 is held by flexible locking pieces 62 of the hood portion 61, the basal end side of the terminal engagement tubular portion 85 is inserted into the holder inserting portion 51 of the housing 17 in an alignable manner. The terminal engagement tubular portion 85 has a terminal engagement space 87 in which the pair of terminals 13 are held. Lances 89 for preventing the terminals 13 from rearward slipping off are projected into the terminal engagement space 87. When the front holder 25 is attached to the housing 17, the holder inserting portion 51 of the housing 17 is communicated with the terminal engagement space 87. Namely, the attachment of the front holder 25 causes the terminals 13 held in the terminal engagement space 87 to be placed in the holder inserting portion 51 of the housing 17.

The mating terminals which are inserted into the counter-terminal insertion ports 83 are electrically connected to the terminals 13 that are accommodated in the terminal engagement space 87 of the front holder 25, respectively. Even when, in the fitting of the connector, positional displacements due to production tolerance exist between the mating terminals and the terminals 13, the front holder 25 in which the terminals 13 are accommodated is aligned with respect to the holder inserting portion 51, and the tolerance can be absorbed. Moreover, the front holder 25 prevents the unit packing 39 attached to the hood portion 61 of the housing 17, from slipping off.

The electromagnetic shielding braid 27 is configured by weaving conductive metal strands at a predetermined braiding angle into a tubular shape. The braid which is woven into a tubular shape covers the external wires 15. The electromagnetic shielding braid 27 is connected to the shield shell 33 by the metal band 29.

The metal band 29 is formed into an annular shape by using a conductive metal. When the tip end of the metal band 29 is inserted into the lock portion disposed in the basal end, the diameter can be reduced. This enables the electromagnetic shielding braid 27 which covers the outer circumference of the shield shell 33, to be fastened from the outer circumference.

The rubber plug 31 is formed into a long columnar shape by using an elastic material such as rubber. A pair of external-wire passing holes 91 are opened in the rubber plug 31. The external wires 15 are passed through the external-wire passing holes 91, respectively. The rubber plug 31 is inserted into the external-wire leading portion 53 of the housing 17. Therefore, the spaces between the external wires 15 and the external-wire leading portion 53 are watertightly sealed with the rubber plug 31. The rear holder 23 prevents the rubber plug 31 from slipping off of the housing 17.

The shield shell 33 is formed into a box-like shape by a steel plate and a metal such as steel, aluminum, or an aluminum alloy, to function as an electromagnetic shield for the housing 17. The shield shell 33 covers the side of the outer corner of the housing 17.

The shell fixing bolts 35 bolt-fix the shield shell 33 to the housing 17. Two shell fixing bolts 35 are used. The shell fixing bolts 35 are screwed to shell bolt fixing portions 93 which are formed in right and left sides (right and left sides in FIG. 4) of the back surface of the housing 17, respectively. The shell fixing bolts 35 which are passed through the shield shell 33 are screwed to the shell bolt fixing portions 93 of the housing 17, whereby the shield shell is integrally and firmly fixed to the housing 17. A pair of apparatus fixing holes 95 are formed in the shield shell 33. The shield shell 33 is bolt-fixed to a shield case of the electric apparatus by means of the apparatus fixing holes 95, whereby the housing 17 is fixed to the electric apparatus.

The shell holder 37 is made of a conductive metal, and has a hood passing portion 97 and a shell coupling portion 99. The shell holder 37 covers the inner corner side of the housing 17. In the shell holder 37, the shell coupling portion 99 is fixed to the shield shell 33 in a state where the hood portion 61 of the housing 17 is passed through the hood passing portion 97. The shell coupling portion 99 and the shield shell 33 are fixed to each other by, for example, an elastic engagement piece 101 which is disposed over the both members, engagement holes, and the like. In the housing 17 to which the shield shell 33 and the shell holder 37 are attached, the most part other than the hood portion 61 is covered by the shield shell 33 and the shell holder 37.

The unit packing 39 is formed into an annular shape by using an elastic material such as rubber. The unit packing 39 is attached to the outer circumference of the hood portion 61. The unit packing 39 is prevented by the front holder 25 from slipping off of the hood portion 61. The connector 11 is attached to the shield case of the electric apparatus by inserting the hood portion 61 into an attachment insertion hole (not shown) of the shield case. In this case, the unit packing 39 watertightly seals between the hood portion 61 and the attachment insertion hole.

The terminal fixing nuts 41 are embedded in the inner wall surface 103 of the inner corner of the housing 17, by insert molding or the like. The number of the terminal fixing nuts 41 corresponds to that of the conductor coupling fixed terminals 21. The bolts 75 which are passed through the bolt passing holes 67 formed in the intermediate portions 65 of the conductor coupling fixed terminals 21 are screwed with the terminal fixing nuts 41, respectively. Namely, the terminal fixing nuts 41 are used for fixing the conductor coupling fixed terminals 21 to the inner wall surface 103 of the housing 17 by means of screwing of the bolts 75.

Next, a method of assembling the thus configured connector 11 will be described. Hereinafter, the assembling method will be described with respect to only the combination of one of the terminals 13, the corresponding flexible conductor 79, and the corresponding external wire 15. The same assembling method can be applied also to the combination of the other terminal 13, the corresponding flexible conductor 79, and the corresponding external wire 15.

Figure 5:
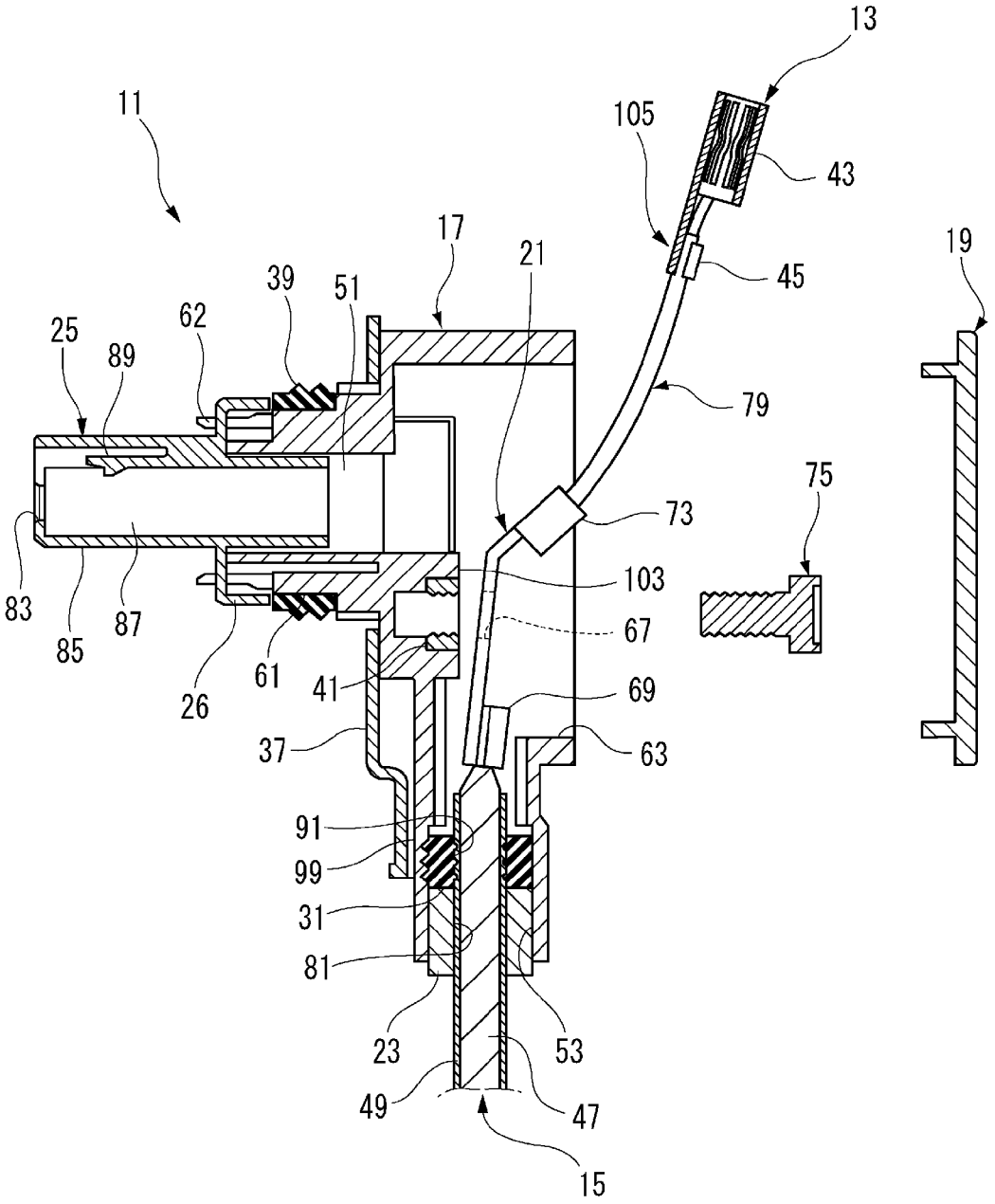
FIG. 5 is a view illustrating steps of installing a terminal, a flexible conductor, and an external wire in the connector shown in FIG. 1.

FIG. 5 is a view illustrating steps of installing the terminal 13, the flexible conductor 79, and the external wire 15 in the connector shown in FIG. 1.

When the connector 11 is to be assembled, the electromagnetic shielding braid 27 is first removed away, and the external wire 15 is exposed. The exposed external wire 15 is passed through the rear holder 23, and the rear holder 23 is attached to the external wire 15. The external wire 15 which is passed through the rear holder 23 is passed through the rubber plug 31. In the external wire 15 which is passed through the rubber plug 31, the core wire 47 is exposed by removing the covering portion 49. The wire conductor connecting portion 69 of the conductor-side coupling fixed terminals 21 is connected to the exposed core wire 47 by crimping or the like.

In the conductor coupling fixed terminal 21, another end portion of the flexible conductor 79 is connected to the flexible conductor-side connecting portion 73 by crimping or the like. The terminal 13 is fixed to one end portion of the flexible conductor-side connecting portion 73 by crimping or the like. In the external wire 15, therefore, an intra-housing routing portion 105 is formed in which the terminal 13, the flexible conductor 79, and the conductor coupling fixed terminal 21 are sequentially connected to one another with starting from the tip end side.

In the external wire 15, the intra-housing routing portion 105 is inserted from the external-wire leading portion 53 of the housing 17. The terminal 13 is once drawn out from the intra-housing routing portion 105 inserted into the housing 17, to the outside through the work opening 63. In this case, as shown in FIG. 5, the flexible conductor 79 enables the terminal 13 to be easily drawn out through the work opening 63. Thereafter, the terminal 13 is again inserted into the housing through the work opening 63, passed through the holder inserting portion 51, and attached to the terminal engagement space 87 of the front holder 25. In this case, the flexible conductor 79 forms the loop-like external-force absorbing portion 77 shown in FIG. 3, in the housing 17. Then, the conductor coupling fixed terminal 21 is fixed to the housing 17 by the bolt 75. Next, the work opening 63 is covered by the lid member 19.

Then, the shield shell 33 and the shell holder 37 are installed outside the housing 17. The electromagnetic shielding braid 27 which has been exposed in the rear of the rear holder 23 is fastened to the shield shell 33 and the shell holder 37 by the metal band 29. Thereafter, the front holder 25 is attached to the hood portion 61, thereby completing the assembling of the connector 11.

Figure 6:
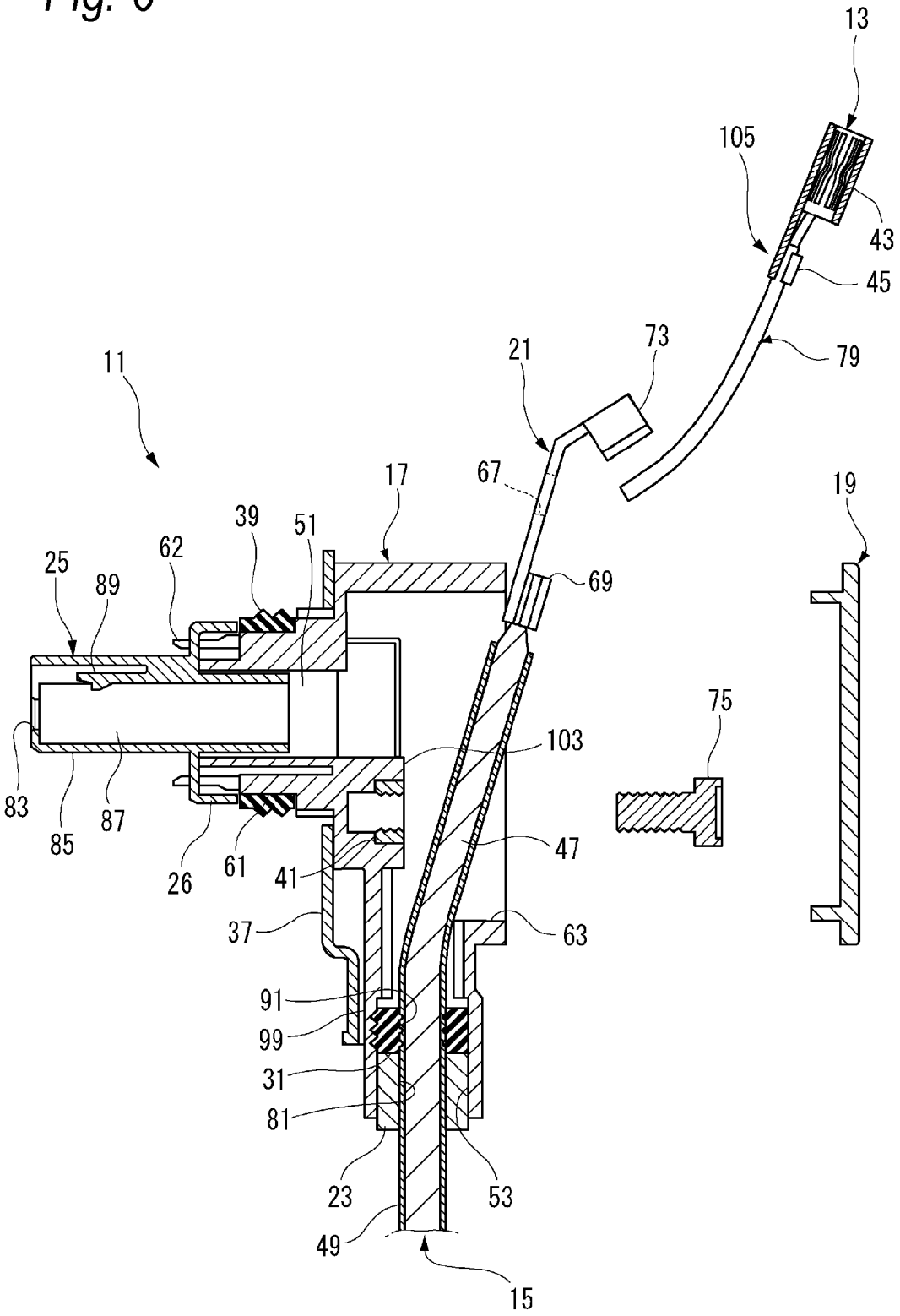
FIG. 6 is a view illustrating assembling steps in a modification in which flexible conductors are externally connected to conductor coupling fixed terminals.
Figure 7:
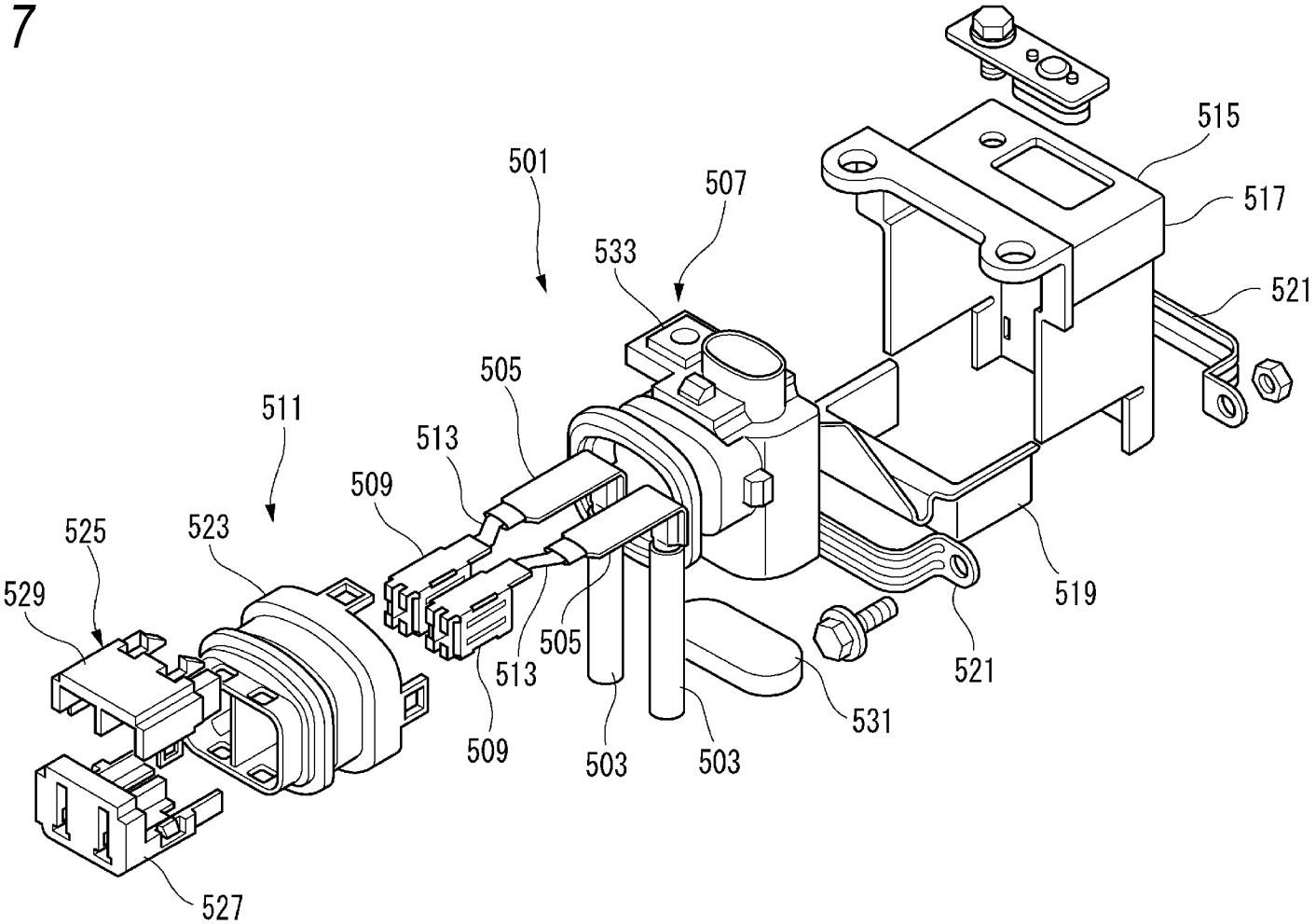
FIG. 7 is an exploded perspective view of a prior art connector.

FIG. 6 is a view illustrating assembling steps in a modification in which the flexible conductors 79 are externally connected to the conductor coupling fixed terminals 21.

In the above-described assembly example, before the insertion into the housing 17, the intra-housing routing portion 105 is previously assembled. In the connector 11, alternatively, the conductor coupling fixed terminal 21 and the flexible conductor 79 may be connected to each other through the work opening 63. In the alternative, the conductor coupling fixed terminal 21 to which the flexible conductor 79 is not connected is drawn out to the outside through the work opening 63. The other end portion of the flexible conductor 79 which is connected to the terminal 13 is fixed outside the housing 17 to the flexible conductor-side connecting portion 73 of the conductor coupling fixed terminal 21. In a similar manner as the above-described assembly example, then, the flexible conductor 79 is bent, and the terminal 13 is passed through the holder inserting portion 51, and attached to the front holder 25. Thereafter, the work opening 63 is covered by the lid member 19, and the assembling of the connector 11 is completed in a similar manner as the assembly example.

Next, the function of the thus configured connector 11 of the embodiment will be described.

In the connector 11 of the embodiment, the conductor coupling fixed terminal 21 and the terminal 13 are connected to each other by the flexible conductor 79 made of a soft member which can absorb a positional displacement between the conductor coupling fixed terminal 21 and the terminal 13. In the flexible conductor, the external-force absorbing portion 77 which is caused to sag by an extra length is disposed. Even when, in fitting of the connector, a positional displacement due to a tolerance exists between the mating terminal and the terminal 13, therefore, the front holder 25 accommodating the terminal 13 is center-aligned with the holder inserting portion 51, and the tolerance can be absorbed. In this case, the positional displacement caused between the conductor coupling fixed terminal 21 and the terminal 13 is absorbed by the flexible conductor 79. Therefore, an excellent contact between the terminal 13 and the mating terminal can be realized.

Moreover, vibrations transmitted from the external wire 15 are blocked by the conductor coupling fixed terminal 21 which is fixed to the housing 17. Even when vibrations of the external wire 15 are transmitted to the conductor coupling fixed terminal 21, the vibrations are absorbed by the external-force absorbing portion 77 of the flexible conductor 79. Therefore, the vibrations are not transmitted to the terminal 13.

Moreover, the conductor coupling fixed terminal 21 is formed so as to be passable through the external-wire leading portion 53. In a state where the conductor coupling fixed terminal 21 is connected to the core wire 47 of the external wire 15, therefore, the conductor coupling fixed terminal can be inserted through the interior of the housing 17. The terminal 13 is connected through the flexible conductor 79 to the other end side of the conductor coupling fixed terminal 21. That is, the external wire 15 can be passed through the interior of the housing 17 from the tip end side of the intra-housing routing portion 105 in which the terminal 13, the flexible conductor 79, and the conductor coupling fixed terminal 21 are sequentially connected to one another. With respect to the terminal 13 which is connected to the conductor coupling fixed terminal 21 through the flexible conductor 79, when the flexible conductor 79 is bent, the terminal can be easily attached to the front holder 25 through the work opening 63.

In the connector 11 of the embodiment, moreover, the conductor coupling fixed terminal 21 which is placed at a predetermined position in the housing 17 can be easily fastened and fixed to the housing 17 by the bolt 75 which is inserted through the work opening 63 of the housing 17.

In the connector 11 of the embodiment, furthermore, the flexible conductor-side connecting portion 73 of the conductor coupling fixed terminal 21 is inclined toward the work opening 63. When, after the conductor coupling fixed terminal 21 is fixed to the housing 17, the flexible conductor-side connecting portion 73 is directed toward the side opposite to the front holder 25, therefore, the external-force absorbing portion 77 of the flexible conductor 79 is formed into a loop-like shape which exerts a large displacement absorbing effect.

In the connector 11 of the embodiment, furthermore, the shield shell 33 which is a rigid member fixed to the shield case of the electric apparatus is bolt-fixed to the housing 17. Even when vibrations of the external wire 15 are transmitted to the housing 17, therefore, a force which may move the housing 17 and the shield shell 33 does not act thereon.

In the connector 11 of the embodiment, furthermore, a braided wire is used in the flexible conductor 79, and therefore excellent softness can be provided to the flexible conductor 79. Since a braided wire is used, moreover, bending of the flexible conductor 79 enables the terminal 13 drawn out through the work opening 63, to be easily inserted into the housing 17 through the work opening 63.

Unlike the prior art, therefore, it is not necessary to perform a cumbersome work in which an L-shaped terminal connected to a thick wire is inserted into or extracted from the housing through the work opening 63. Consequently, the assemblability can be remarkably improved.

According to the connector 11 of the embodiment, therefore, the connector can be easily assembled while improving the contact reliability.

Features of the above-described embodiment of the connector of the invention are listed below in a brief and summarized manner.

[1] The connector (11) comprising:

the terminal (13) configured to be connected to a mating terminal;

the front holder (25) accommodating the terminal (13) therein;

the housing (17) having the L-like bent shape, including the holder inserting portion (51) into which the front holder (25) is inserted in an alignable manner and the external-wire leading portion (53) from which the external wire (15) is led out, and formed with the work opening (63) in the outer surface on the side of the outer corner of the L-like bent shape, wherein the center line (55) of the holder inserting portion (51) extends in the holder inserting direction in which the front holder (25) is inserted into the holder inserting portion (51), the center line (59) of the external-wire leading portion (53) extends along the axis (57) of the external wire (15), and the center line (55) of the holder inserting portion (51) intersects the center line (59) of the external-wire leading portion (53) to form the housing (17) into the L-like bent shape;

the lid member (19) attached to the work opening (63);

the fixed terminal (21) configured to be inserted through the external-wire leading portion (53), and accommodated in the housing (17), wherein one end of the fixed terminal (21) is connected to the conductor (47) of the external wire (15), and the intermediate portion (65) of the fixed terminal (21) is fixed to the housing (17) and elongates along the axis (57) of the external wire (15);

the flexible conductor (79) connecting the terminal (13) to the other end of the fixed terminal (21), and including the external-force absorbing portion (77) sagging between both ends of the flexible conductor (79).

[2] In the connector (11) of [1] above, the intermediate portion (65) of the fixed terminal (21) are fastened and fixed to the housing (17) by the bolt (75) which are inserted through the work opening (63).

[3] In the connector (11) of [1] or [2] above, the portion (73) of the fixed terminal (21) to which the flexible conductor is connected is bent and inclined toward the work opening (63).

[4] In the connector (11) of any one of [1] to [3] above, the shield shell (33) covering the housing (17) and configured to be fixed to the electric apparatus is fixed to the housing (17) by the bolt.

According to the connector having the configuration of [1] above, the conductor coupling fixed terminal and the terminal are connected to each other by the flexible conductor which is formed by a soft member that can absorb a positional displacement between the conductor coupling fixed terminal and the terminal. The external-force absorbing portion that is caused to sag by an extra length is disposed in the flexible conductor. Even when, in fitting of the connector, a positional displacement due to a tolerance exists between the mating terminal and the terminal, therefore, the front holder accommodating the terminal is center-aligned with the holder inserting portion, and the tolerance can be absorbed. In this case, the positional displacement caused between the conductor coupling fixed terminal and the terminal is absorbed by the flexible conductor. Therefore, an excellent contact between the terminal and the mating terminal can be realized.

Moreover, vibrations transmitted from the external wire are blocked by the conductor coupling fixed terminal which is fixed to the housing. Even when vibrations of the external wire are transmitted to the conductor coupling fixed terminal, the vibrations are absorbed by the external-force absorbing portion of the flexible conductor. Therefore, the vibrations are not transmitted to the terminal.

The conductor coupling fixed terminal is formed so as to be passable through the external-wire leading portion. In a state where the conductor coupling fixed terminal is connected to the conductor of the external wire, therefore, the conductor coupling fixed terminal can be inserted through the interior of the housing. The terminal is connected through the flexible conductor to the other end side of the conductor coupling fixed terminal. That is, the external wire can be passed through the interior of the housing from the tip end side in which the terminal, the flexible conductor, and the conductor coupling fixed terminal are sequentially connected to one another. With respect to the terminal which is connected to the conductor coupling fixed terminal through the flexible conductor, when the flexible conductor is bent, the terminal can be easily attached to the front holder through the work opening.

According to the connector having the configuration of [2] above, the conductor coupling fixed terminal which is placed at a predetermined position in the housing can be easily fastened and fixed to the housing by the bolt which is inserted through the work opening of the housing.

According to the connector having the configuration of [3] above, after the conductor coupling fixed terminal is fixed to the housing, the flexible conductor-side connecting portion is directed toward the side opposite to the front holder, and therefore the external-force absorbing portion of the flexible conductor is formed into a loop-like shape which exerts a large displacement absorbing effect.

According to the connector having the configuration of [4] above, even when vibrations of the external wire are transmitted to the housing, a force which may move the housing and the shield shell does not act thereon because the shield shell which is a rigid member fixed to the side of the electric apparatus is bolt-fixed to the housing.

According to the connector of the invention, the connector can be easily assembled while improving the contact reliability.

The invention is not limited to the above-described embodiment, and may be adequately subjected to modifications, improvements, and the like. In addition, the materials, shapes, dimensions, numbers, places, and the like of the components of the above-described embodiment are arbitrary and not limited insofar as the invention is achieved.

What is claimed is:

1. A connector comprising:

a terminal configured to be connected to a mating terminal;

a front holder accommodating the terminal therein;

a housing having an L-like bent shape, including a holder inserting portion into which the front holder is inserted in an alignable manner and an external-wire leading portion from which an external wire is led out, and formed with a work opening in an outer surface on a side of an outer corner of the L-like bent shape, wherein a center line of the holder inserting portion extends in a holder inserting direction in which the front holder is inserted into the holder inserting portion, a center line of the external-wire leading portion extends along an axis of the external wire, and the center line of the holder inserting portion intersects the center line of the external-wire leading portion to form the housing into the L-like bent shape;

a lid member attached to the work opening;

a fixed terminal configured to be inserted through the external-wire leading portion, and accommodated in the housing, wherein one end of the fixed terminal is connected to a conductor of the external wire, and an intermediate portion of the fixed terminal is fixed to the housing and elongates along the axis of the external wire;

a flexible conductor connecting the terminal to the other end of the fixed terminal, and including an external-force absorbing portion sagging between both ends of the flexible conductor.

2. The connector according to claim 1, wherein the intermediate portion of the fixed terminal is fastened and fixed to the housing by a bolt which is inserted through the work opening.

3. The connector according to claim 1, wherein a portion of the fixed terminal to which the flexible conductor is connected is bent and inclined toward the work opening.

4. The connector according to claim 1, wherein a shield shell covering the housing and configured to be fixed to an electric apparatus is fixed to the housing by a bolt.

* * * * *